US005963178A

United States Patent [19]

Jones

[11] Patent Number: 5,963,178

[45] Date of Patent: Oct. 5, 1999

[54] WIRELESS COMMUNICATION POLE SYSTEM AND METHOD OF USE

[75] Inventor: Charles H. Jones, Atlanta, Ga.

[73] Assignee: Telestructures, Inc., Alpharetta, Ga.

[21] Appl. No.: 09/038,002

[22] Filed: Mar. 11, 1998

Related U.S. Application Data

[60] Provisional application No. 60/049,706, Jun. 16, 1997.

[51] Int. Cl.[6] ..... H01Q 1/12

[52] U.S. Cl. ..... 343/890; 343/891

[58] Field of Search ..... 343/720, 721, 343/872, 890, 891, 878; 52/111, 115, 119, 120

[56] References Cited

U.S. PATENT DOCUMENTS

| | | | |
|---|---|---|---|
| 857,152 | 6/1907 | Brown | 343/890 |
| 3,555,552 | 1/1971 | Alford | 343/890 |
| 4,356,498 | 10/1982 | Pollard | 343/890 |
| 4,603,333 | 7/1986 | Carlson | 343/709 |
| 4,932,910 | 6/1990 | Hayday | 441/11 |
| 5,570,546 | 11/1996 | Butterworth et al. | 343/890 |
| 5,757,324 | 5/1998 | Helms et al. | 343/890 |

*Primary Examiner*—Don Wong
*Assistant Examiner*—Tho Phan
*Attorney, Agent, or Firm*—Dickinson Wright PLLC

[57] ABSTRACT

A cell site pole assembly is integrated with various antennas and pole components so that the pole assembly can be readily installed at a cell site without the need for extensive wiring, pole component assembly or the like. The pole assembly also includes a lightweight fiberglass housing which surrounds the antenna but does not interfere with antenna functioning. The pole assembly can have a counterbalance system to easily raise or lower the housing for access to the antenna. The pole assembly is designed to employ other features such as lighting or decorative/symbolic components to enhance the aesthetic appearance of the pole when situated in a community environment.

22 Claims, 9 Drawing Sheets

FIG, 5
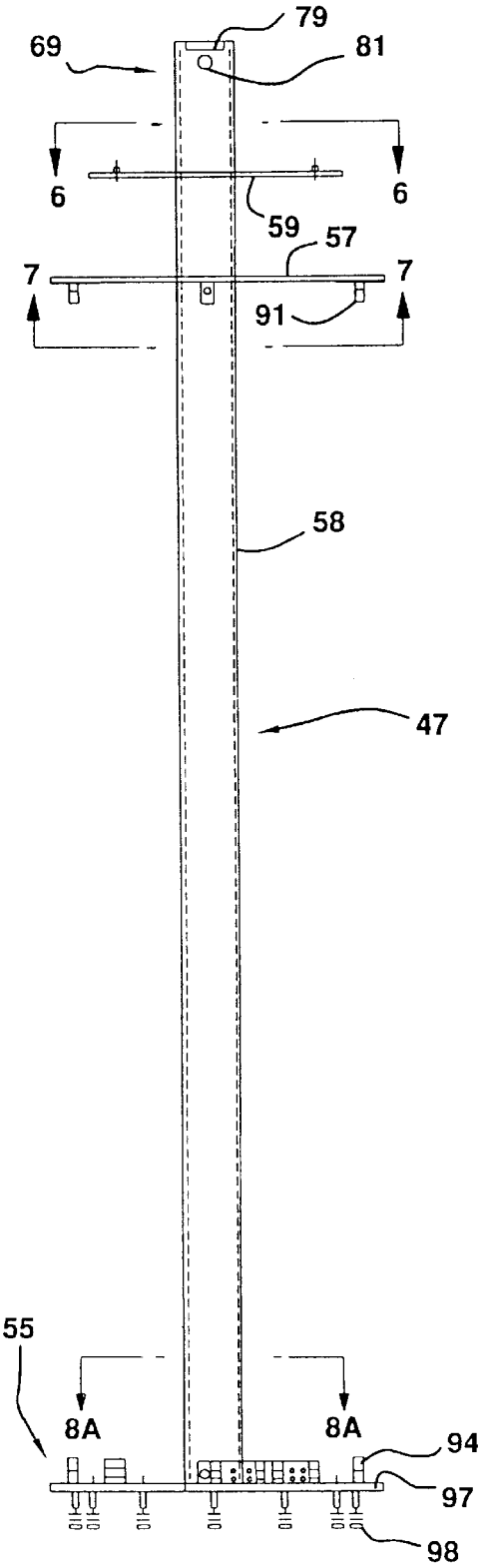
FIG. 6
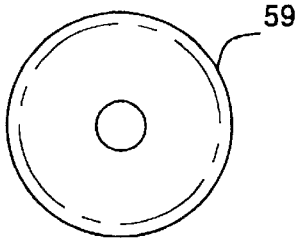
FIG. 7
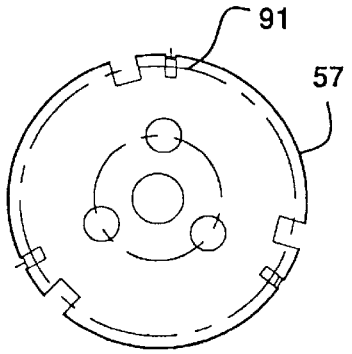
FIG. 8A
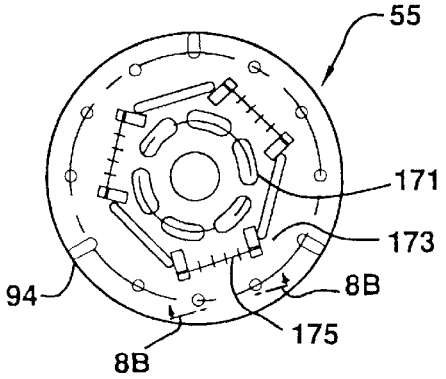
FIG. 8B
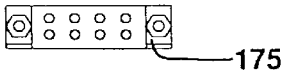

1 :Mkr (MHz) dB

1 :1850.00 -18.045
2 :1870.00 -19.930
3 :1890.00 -18.982
4 :1910 00 -17.554
5 :1930.00 -17.476
6 :1950.00 -18.527
7 :1970.00 -21.319
8 :1990.00 -22.945

2 :Mrk (MHz) dB

1 :1850.00 -31.422
2 :1870.00 -29.532
3 :1890.00 -27.206
4 :1910 00 -25.181
5 :1930.00 -23.867
6 :1950.00 -22.796
7 :1970.00 -21.930
8 :1990.00 -21.508

| 1 :Mkr (MHz) | dB | 2 :Mrk (MHz) | dB |
|---|---|---|---|
| 1 :1050.00 | -18.422 | 1 :1850.00 | -31.591 |
| 2 :1870.00 | -22.953 | 2 :1870.00 | -29.494 |
| 3 :1890.00 | -27.069 | 3 :1890.00 | -27.723 |
| 4 :1910 00 | -26.091 | 4 :1910 00 | -26.271 |
| 5 :1930.00 | -24.959 | 5 :1930.00 | -25.060 |
| 6 :1950.00 | -24.510 | 6 :1950.00 | -24.128 |
| 7 :1970.00 | -25.070 | 7 :1970.00 | -23.312 |
| 8 :1990.00 | -24.711 | 8 :1990.00 | -22.805 |

WIRELESS COMMUNICATION POLE SYSTEM AND METHOD OF USE

This Appln. claims the benefit of U.S. Provisional Appln. No. 60/049,706 filed Jun. 16, 1997.

FIELD OF THE INVENTION

The present invention is directed to a wireless communication pole system and a method of use and, in particular, to a pole system that is fully integrated for rapid installation and includes systems to ease antenna maintenance.

BACKGROUND ART

In the field of cellular or other wireless communication devices, cell sites are required to handle wireless communication traffic. With the popularity of cellular phones and the development of an increased number of radio-based communication services, the number of cell sites presently available are inadequate to meet the needs of the future. Moreover, cell sites can no longer be limited to building tops or 150 foot towers to provide the pinpoint, error free, quality radio coverage demanded by customers. Sites are required to be lower in height and spaced even closer together, encroaching even into neighborhoods, parks and environmentally sensitive areas.

Many cell site poles have integral antenna assemblies which are self contained in a structure that is not accessible. With this construction, some disassembly is required for maintenance and/or repair. Often times, the antennas are enclosed in a plastic cylinder which is flexible if compressed. While the plastic cylinders can be painted, the durability of the paint coating is not guaranteed and the aesthetic appearance of these types of poles could deteriorate over time.

Accordingly, a need has developed to provide wireless communication cell sites or pole systems that are aesthetic, easy to install, and easy to maintain. The invention solves this need by providing a wireless communication pole system with a fully integrated design permitting rapid installation, easy maintenance of the pole antenna system, an aesthetic design, and a modular construction permitting the use of different ornamental structures in combination with the pole to fit different settings.

SUMMARY OF THE INVENTION

Accordingly, it is a first object of the invention to provide a cell site pole assembly integrating all of the antenna, transmission cable, connectors, grounding, lightning protection, vertical support, and foundation components for rapid installation.

Another object of the invention is a cell site pole assembly that adds aesthetic customization to enhance acceptance for community siting.

A further object of the invention is a cell site pole assembly that facilitates antenna access for field repairs of the antenna components.

A still further object of the invention is a cell site pole assembly that accommodates various types of antennas without the need for pole modification.

One other object of the invention is a method of installing the cell site pole that requires a minimum amount of time.

Other objects and advantages of the present invention will become apparent as a description proceeds.

In satisfaction of the foregoing objects and advantages, the present invention comprises a cell site pole assembly that has many of the components pre-installed so that field installation requires little assembly time prior to pole erection. The cell site pole assembly includes a foundation which is attachable to a cell site pole. The pole itself is preferably made of galvanized steel of a predetermined length depending on the pole application. An antenna spool assembly is connected to the top of the pole. The antenna spool assembly is shrouded by a pod that is vertically movable to provide easy access to the antenna components.

The pole assembly is designed with prefabricated features to receive different ornamental or functional features to enhance the pole's utility or aesthetic appearance. For example, the pole could support light fixtures to function as a street light as well as a cell site. The pole assembly could also include a base enclosure which is merely decorative or has functional features such as storage space. Similarly, the pole top can include features to enhance the pole's appearance such as a weathervane or the like. The pole assembly can be fabricated in different colors to blend in with its environment.

The pole itself can include internal connectors, preferably made of copper, at one or both ends. The connectors permit pre-installation of transmission cables along the length of the pole. With this arrangement, cables do not have to be run through the pole at the installation site. Rather, installers merely have to connect incoming cables to the connector at the pole base. Likewise, the cables of the antenna spool assembly need only to be connected to the connector positioned near the top of the pole. The connectors can also include lightning arrestors for safety purposes. The connectors are accessible by doors in the pole.

The antenna spool assembly has several features that contribute to the overall effectiveness of the pole assembly. First, the fit between a base of the antenna spool and a top of the pole allows for easy routing of cables between the spool assembly and the connector in the pole.

Second, the spool assembly employs a fiberglass housing that permits the RF transmission signal to pass through the housing without adversely affecting the antenna pattern loss. The housing can have a cylindrical shape to permit a 360° orientation of the antennas without any physical obstruction. Thus, the antenna azimuth can be oriented in any vertical configuration. The housing can be sized to accommodate a variety of different types of antennas as wells as antenna downtilting, thereby avoiding the necessity of reengineering the spool assembly. By the antenna spool and pole design, the housing can function without a significant structural bracing. Since the housing is made of fiberglass, the housing is light in weight which makes it easy to be moved when it is desired to access the antenna components.

Third, the antenna spool assembly employs a unique mechanism to raise and/or lower the housing to expose the antenna for repair, maintenance or the like. The housing is slightly larger than the connection between the spool and the top of the pole so that it can be lowered past this point. A counterbalance system is arranged as part of the spool assembly which allows a worker to apply a force to the housing in either an upward or downward direction. Application of the force in conjunction with the counterbalance system moves the housing in the direction of the applied force. If a worker needs to access the antenna, the worker would merely push or pull down on the housing, either by hand or with a tool, and the housing would slide down the antenna spool to expose the antenna components. Once the worker is finished, the housing would be pushed or pulled upward to again enclose the antenna.

In use, the pole assembly is delivered to a particular site. A hole is dug to receive the foundation, either before, after or during pole delivery. The foundation, preferably a precast concrete cylindrical footer of sufficient diameter and length to support the pole, is installed in the hole and the pole assembly is erected and attached to the foundation, including making all the necessary cable connections. The antenna spool assembly can be attached to the pole prior to pole delivery to the site, at the site and prior to pole attachment to the foundation or after pole attachment to the foundation. Preferably, the spool is attached prior to pole delivery or at the site prior to pole erection. Any decorative or functional features of the pole assembly can be attached prior to pole delivery or at the site. For lighting fixtures, attachment may be required at the site due to the difficulty in transporting the pole if the lighting fixtures extend outwardly in a manner that may disrupt traffic during pole transport. Multiple antennas can also be employed.

BRIEF DESCRIPTION OF THE DRAWINGS

Reference is now made to the drawings of the invention wherein:

FIG. 5 is an elevational view of the spool of the antenna assembly of FIG. 4;

FIG. 6 is an end view along the line VI—VI of FIG. 5;

FIG. 7 is an end view along the line VII—VII of FIG. 5;

FIG. 8A is an end view along the line VIIIA—VIIIA of FIG. 5;

FIG. 8B is an end view along the line VIIIB—VIIIB of FIG. 5;

DESCRIPTION OF THE PREFERRED EMBODIMENTS

Figure 1:
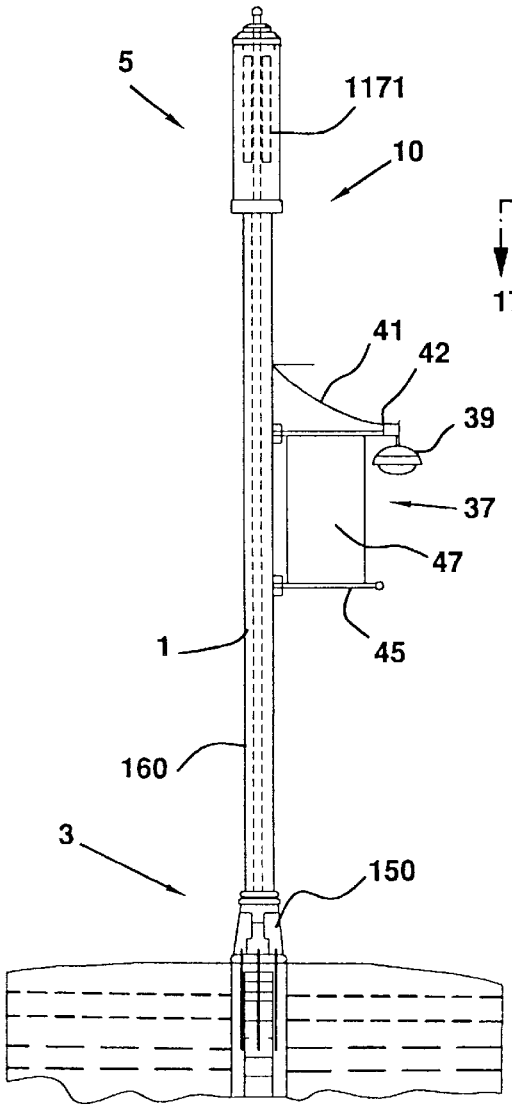
FIG. 1 is an elevational view of one embodiment of the invention.
Figure 16:
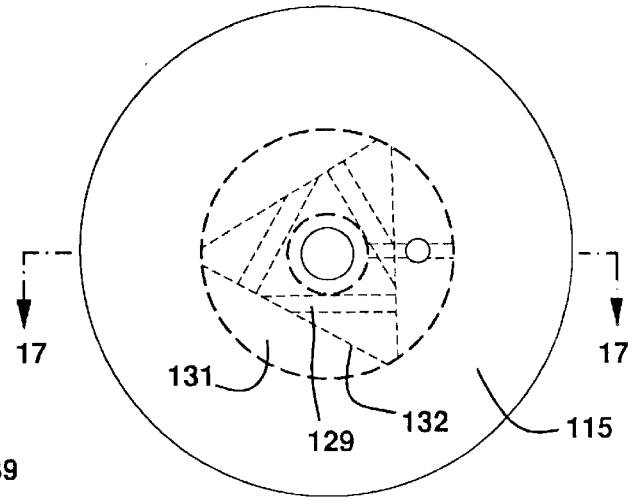
FIG. 16 is a top view of the arrangement of FIG. 14B.
Figure 17:
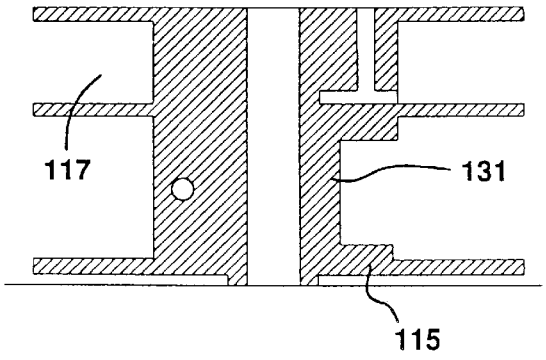
FIG. 17 is a sectional view along the line XVII—XVII of FIG. 16.

FIG. 1 shows an elevational view of one embodiment of the pole assembly of the invention wherein the pole doubles as a banner-carrying light pole. The embodiment, designated by the reference numeral 10, includes a pole 1, a base assembly 3 and an antenna assembly 5.

Figure 2:
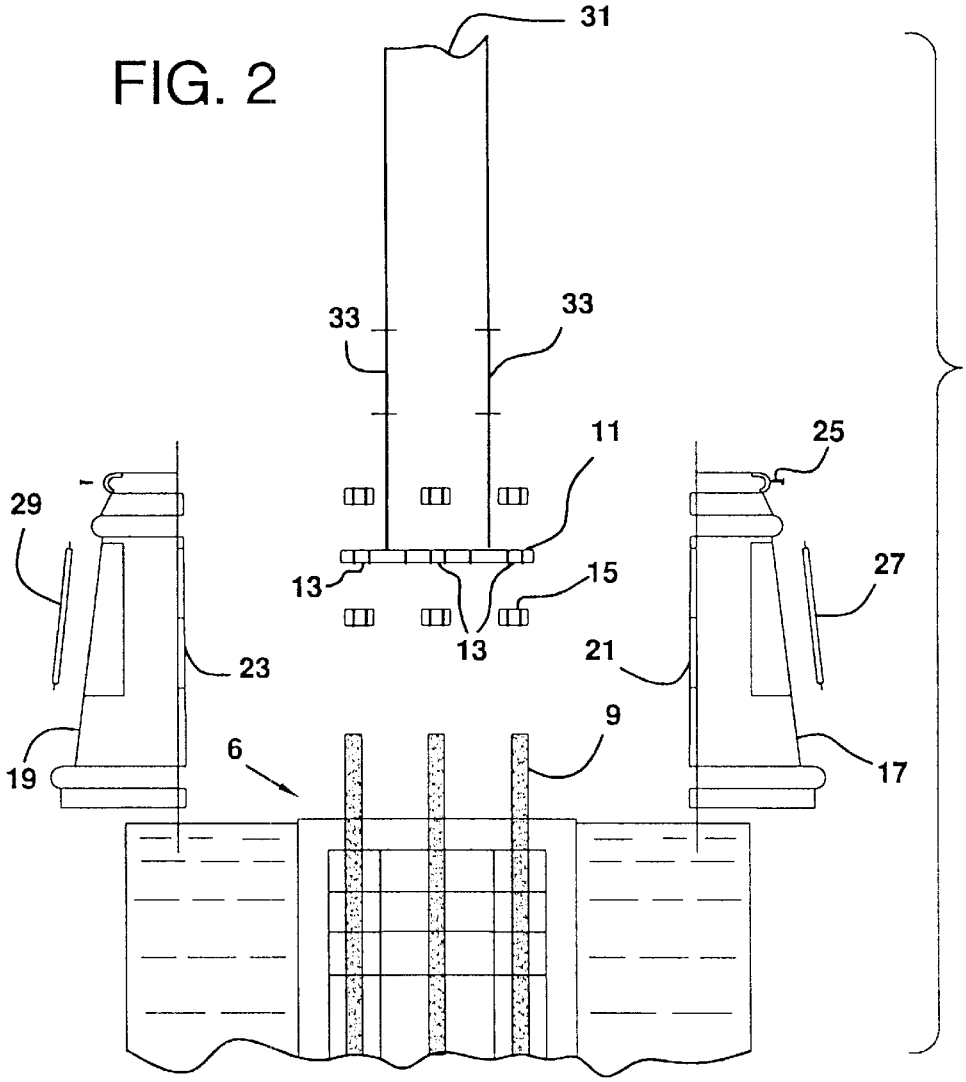
FIG. 2 is an exploded elevational view of the base assembly of the pole of FIG. 1.

Referring to FIG. 2, the base assembly 3 includes a foundation designated by the reference numeral 6 which further comprises a concrete footer 7 and a plurality of anchor bolts 9 extending therefrom.

The pole 1 has a bottom flange 11 with throughopenings 13. The through openings 13 are sized to receive the anchor bolts 9 for flange securement. In this embodiment, four anchor bolts are arranged in a circular pattern, the anchor bolts secured to the flange 11 via the nuts 15. Other ways or means to attach the foundation to the pole can be used as would be within the skill of the art.

Figure 3:
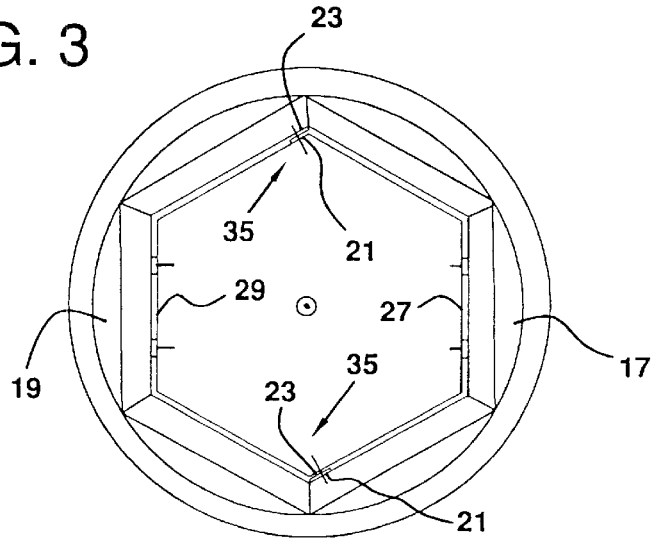
FIG. 3 is a sectional view along the line III—III of FIG. 2.

Referring to FIGS. 2 and 3, the connection between the pole 1 and the foundation 6 is enclosed by base enclosure halves 17 and 19, the halves fastened together at respective ends 21 and 23. Set screws 25 are used to secure the halves 17 and 19 to the pole 1. Although a lap joint 35 is illustrated in FIG. 3 to facilitate connection between the ends 21 and 23, other modes of connection can be employed as part of the base assembly 5.

Each of the halves 17 and 19 have covers 27 and 29. The covers 27 and 29 permit access to the pole access covers 33, which in turn allow access to the pole interior 31. Preferably, the base assembly enclosure halves 17 and 19 are fiberglass and the pole 1 and covers 33 are galvanized steel. Of course, other materials of construction can be utilized as would be within the skill of the art.

Referring back to FIG. 1, the pole assembly 10 also illustrates a light/banner assembly 37. This assembly includes a light fixture 39 supported by arms 41 and 42, each arm mounted to the pole 1. The assembly 37 also includes a lower arm 45 and a banner 47 mounted between arms 42 and 45. It should be understood that the light/banner assembly 37 is optional and the pole assembly 10 could be installed without any such decorative or functional accessory. Alternatively, other styles of light fixtures and/or banner arrangements could be utilized, depending on the desired look and environment of installation. The various connections between the components can be any conventional type.

Figure 4:
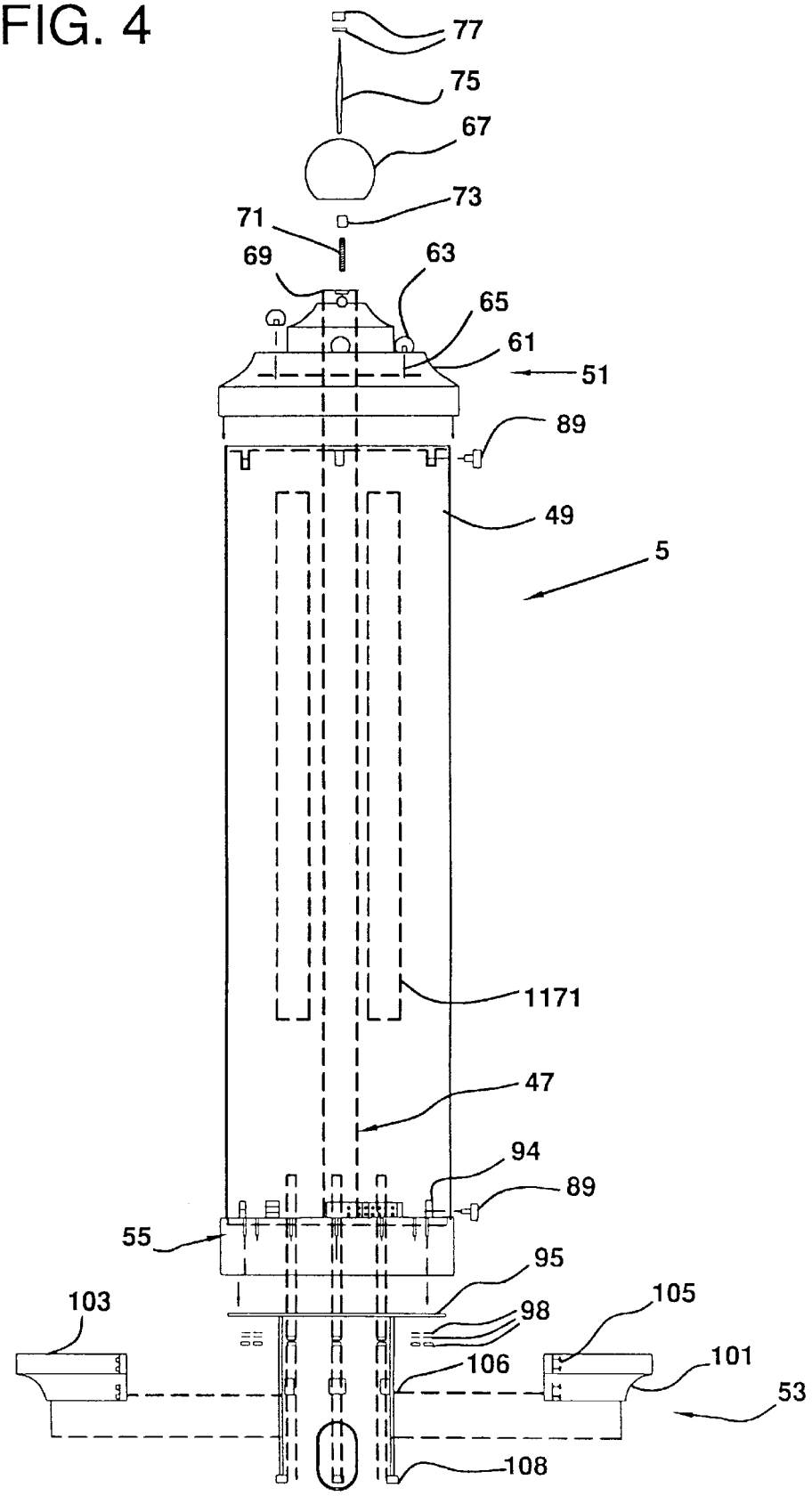
FIG. 4 is an exploded elevational view of the antenna assembly of the pole of FIG. 1.

FIG. 4 more clearly illustrates the antenna assembly 5. The assembly 5 includes a spool 47 and a housing or radome 49. The radome 49 is typically cylindrical in cross sectional shape. Perched atop the spool 47 and radome 49 is a cap assembly 51. A lower shroud assembly 53 is positioned beneath the spool 47 and radome 49.

The spool 47 is shown in more detail in FIGS. 4–8B. The spool 47 has a base flange 55, a radome support base 57, the flange 55 and base 57 separated by the shaft 58. Extending above the radome support base 57 is a cap assembly support base 59. The cap assembly support base 59 supports the cap 61 via the fasteners 63 and threaded rods 65.

Still with reference to FIG. 4, the cap assembly 51 also includes a ball cap 67 affixed to the spool shaft end 69 via the threaded rod 71, coupling 73, lightning rod 75 and nut/washer combination 77. The threaded rod 71 attaches to the tapped hole 79 in the shaft end 69. The shaft end 69 also has a hoisting opening 81 for lifting of the pole assembly 10. Preferred materials of construction include fiberglass for the ball cap 67, bronze for the lightning rod and steel for the connecting fasteners. It should be understood that the cap assembly 51 is exemplary and other cap constructions and/or designs could be used as part of the inventive pole assembly.

Figure 9:
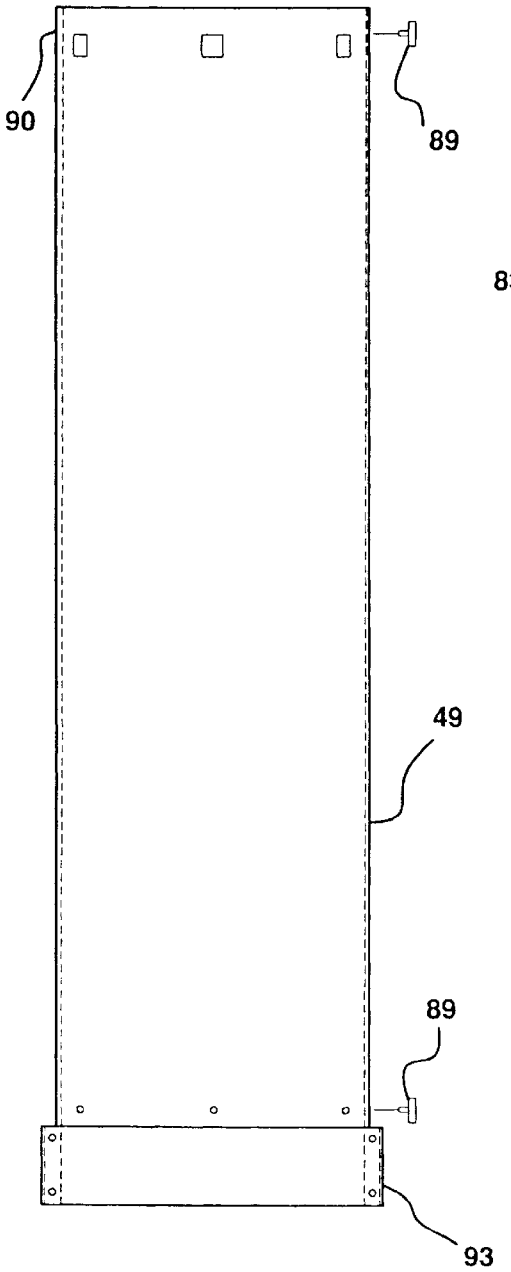
FIG. 9 is an elevational view of the radome of the antenna assembly of FIG. 4.
Figure 10:
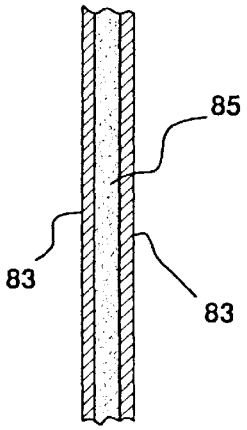
FIGS. 10 and 11 are partial sectional views of the radome of FIG. 9.

The radome 49 is illustrated in FIG. 9 with its wall construction shown in FIG. 10. More specifically, the radome 49 is generally cylindrical in nature and composed of a laminate construction. The laminate construction comprises a foam core 85 and fiberglass layers 83. The thickness of the various layers can vary but are preferably 5/32 inches for the inner foam layer 85 and 1/16 inch for the fiberglass layers 83.

Figure 11:
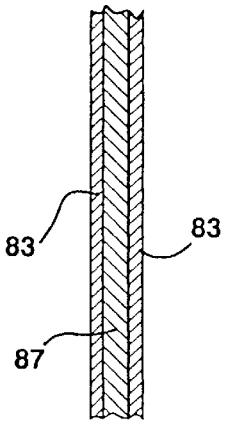
Figure 12:
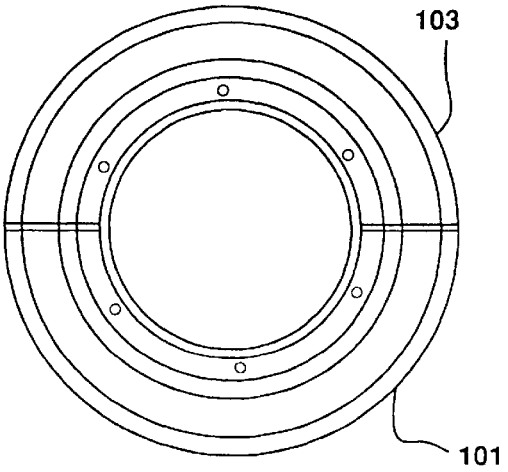
FIG. 12 is and end view of the lower shroud depicted in FIG. 4.

FIG. 11 shows a sectional view of the upper end 90 of the radome 49 that utilizes a steel band, preferably spaced 1-½ inches below the radome upper edge, to aid in radome support. FIG. 11 illustrates the band construction in combination with the fiberglass layers. The band 87, preferably 3 inches wide by 3/16 inch thick, is shown disposed between the layers 83.

The upper end 90 of the radome 49 is linked to the spool 47 via the fasteners 89 interfacing with the flanges 91 found on the radome support base 57, see FIGS. 4 and 5. The lower portion of the radome also uses fasteners 89 for attachment to the flanges 94 on the spool base flange 55.

The radome 49 also includes an enlarged diameter section 93 at the lower portion thereof which provides symmetry with the similarly shaped lower section of the cap 61, see FIG. 5.

The spoof base flange 55 is attached to the pole via pole flange 95. More specifically, threaded studs 97 extending from the lower surface of the base flange 55 interface with throughopenings in the pole top flange 95 and nut/washer combinations 98. The connection of the spool base 55 to the pole top flange 95 is enclosed by the radome section 93.

The lower shroud assembly 53 comprises two halves 101 and 103, the halves attached together via fasteners 105. The assembled shroud halves are then secured to the pole using the shroud cups 106 and fastening nuts 108. The shroud assembly 53 is exemplary and other designs and/or configurations can be utilized as part of the antenna assembly 5.

Figure 13:
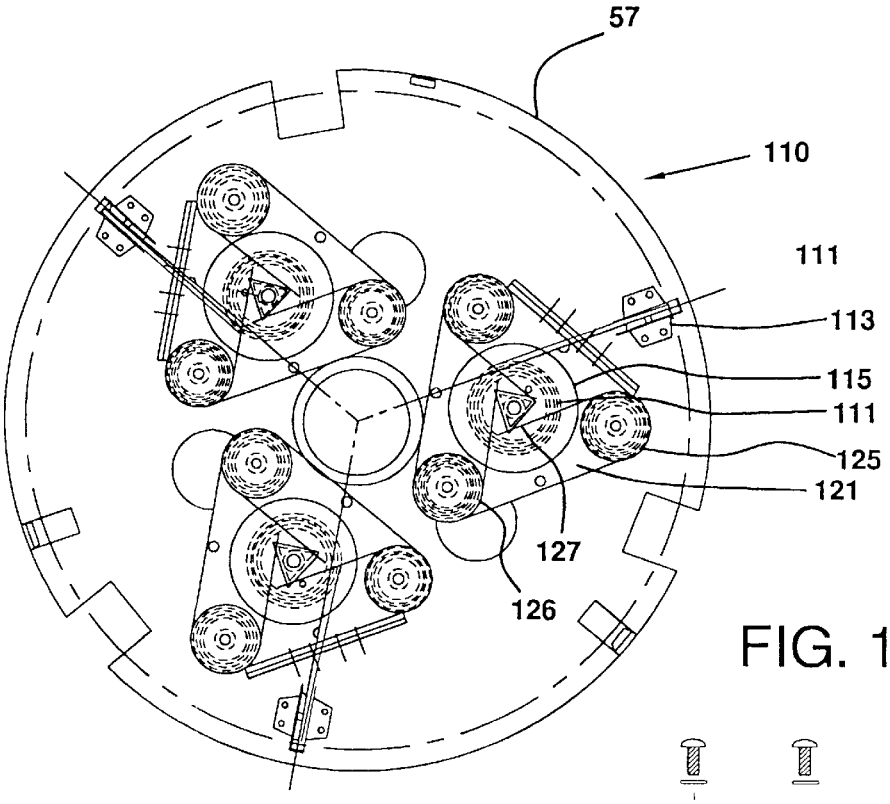
FIG. 13 is a top view of the counterbalance system of the antenna assembly of the pole of FIG. 1.
Figure 14A:
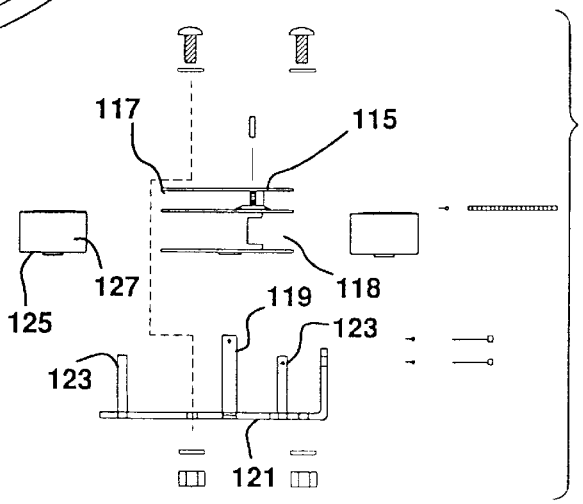
FIG. 14A is an exploded view of one of the counterbalance arrangements of FIG. 13.

The radome 49 is movable about its longitudinal axis by means of a counterbalance assembly 110 which is depicted in FIG. 13. The assembly 110 allows for lowering and/or raising of the radome with minimal effort on the part of a person servicing the antenna components. The radome 49 is linked to the counter-balance assembly 110 via cables 111 that are guided via the roller guides 113. The cables can be affixed to the radome in any conventional manner.

The counterbalance assembly 110 is preferably designed with three spring/pulley systems, each system mounted to the upper radome support plate 57 of the spool. Each system has a cluster of three springs with a dual pulley or drum 115 centered within the cluster. The dual level of the drum 115 allows the three springs to attach to the drum at the lower level and also allows for the supporting cable for the radome 49 to attach to the upper level of the drum 115. The three spring/pulley systems are preferably set 120° apart within the radome diameter (other spacings or numbers of systems could be used). The cabling 111 of each system is attached to the radome at 120° segments as well. In use, the fiberglass radome 49 can be lowered using the counterbalance assembly as described below once the lower shroud 53 is removed. The radome is sized to be slightly larger, for example, 1/8 inch, than the mating surfaces of the spool base flange 55 and the pole top plate 95 to permit it to lower down the pole.

Referring to FIGS. 13–17, the drum 115 of the counterbalance assembly 110 has a cable storage reel 117. The drum 115, also having a spring take-up reel 118, is mounted for rotation on a pin 119 extending upwardly from a mounting plate 121, the plate 121 secured to the plate 57, see FIG. 14A. The mounting plate 121 has pins 123 extending upwardly therefrom, the pins receiving the take-up drums 125. Each drum 125 holds a spring 126 coiled thereon. One end 127 of each spring 126 is secured to the take-up reel 118. More specifically, the take-up reel 118 has a triangularly sectioned portion 131, the portion 131 having faces 132 to facilitate attachment of the respective spring ends 127. Each spring end 127 can be secured to the face 132 by a fastener engaging the threaded port 129 associated with each face.

In use, when the radome is in the uppermost position, the springs 126 that are wound around the drums 125 are at rest. Applying a downward force to the radome 49 unwinds the cable 111 from the drum 115, thereby rotating the drum 115. Rotation of the drum 115 retracts the springs 126 from the drums 125, the springs 126 accumulating on the take-up reel 118. The springs 126 are appropriately tensioned so that the radome 49 can be lowered in a controlled fashion, e.g., lowered to a point of rest to expose the antenna mounted on the spool 47. Lowering of the radome 49 permits a technician or other individual to access the antenna 1171, see FIG. 4, mounted to the antenna spool 47. Once service on the antenna is complete, the radome 49 can be raised or pushed upwardly, the raising causing the springs 126 to coil around the drums 125 and accumulate the cables 111 around the drums 115.

As part of the radome lowering, the lower shroud assembly 53 should be removed and then reinstalled once the radome is back in its uppermost position. It should be understood that the counterbalance assembly shown in FIGS. 13–17 is exemplary and other designs can be employed which perform the same function as that disclosed, i.e., a mechanism which allows an individual either alone or with a tool to vertically move the radome to expose one or more of the antenna components. Of course, the radome 49 could also be secured in place with fasteners or the like so as to be removed without the benefit of a counterbalance system rather than be used with a system that permits radome raising or lowering. For example, the radome could be merely separated from the spool and lowered using a cable hooked to a crane.

Figure 15:
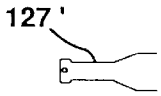
FIG. 15 is an alternative spring end for the arrangement of FIGS. 14A and 14B.
Figure 14B:
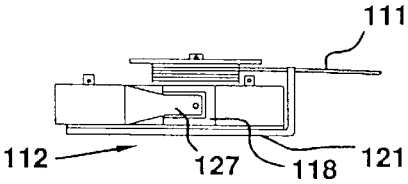
FIG. 14B shows the arrangement of FIG. 14 assembled.
Figure 18:
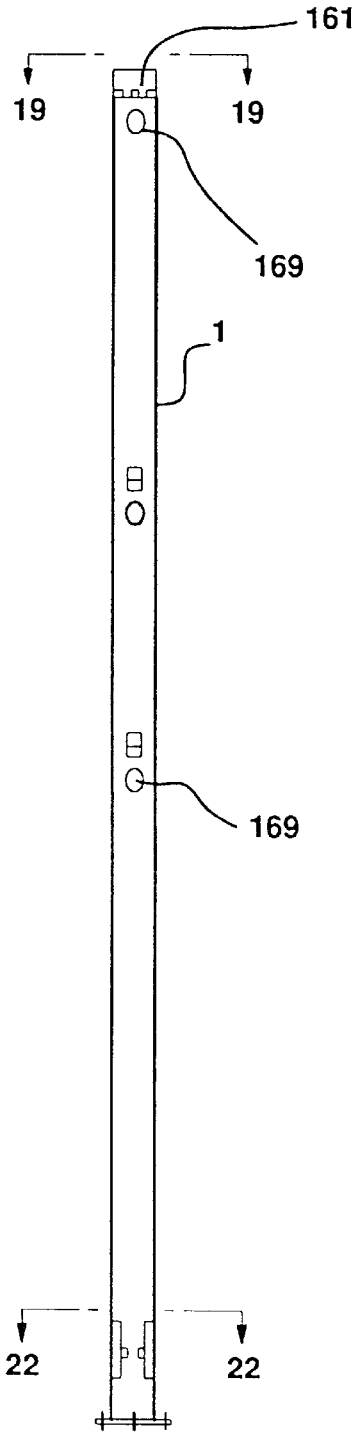
FIG. 18 is an elevational view of the pole alone shown in FIG. 1.
Figure 19:
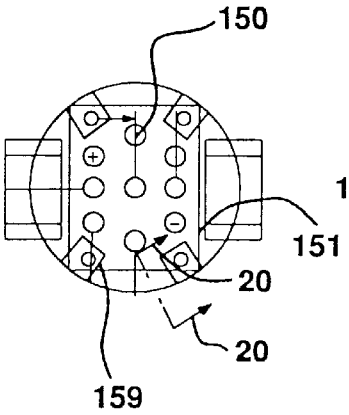
FIG. 19 is a sectional view along the line XIX—XIX of FIG. 18.
Figure 20:
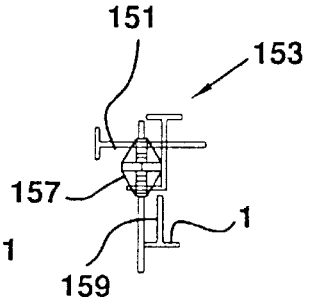
FIG. 20 is a sectional view along the line XX—XX of FIG. 19.
Figure 22:
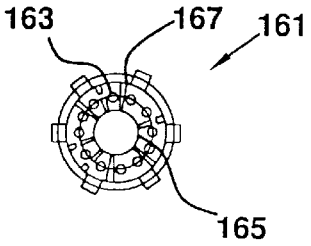
FIG. 22 is a sectional view along the line XXI—XXI of FIG. 18.
Figure 21:
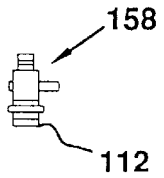
FIG. 21 shows an exemplary lightning arrestor

FIG. 15 shows an alternative spring end attachment configuration 127 ☞. In this embodiment, the spring end has an enlarged end portion as compared to the spring end shown in FIG. 14B.

The inventive pole assembly 10 also includes an improved means or way to connect in-ground antenna cabling to the cabling associated with the pole assembly. This base connection is designated by the reference numeral 150 in FIG. 1 and more clearly illustrated in FIGS. 18–22. The base connector 150 comprises a rectangularly shaped copper plate 151 which is supported by the pole via the insulator 157 and insulator bracket 159. The insulator bracket 159 can be welded to the pole, the insulator providing electrical separation between the copper plate 151 and the pole 1.

Mounted to the copper plate 151 are connectors 158. One end of the connector, e.g., 162, is attached to the copper plate 151. This end is designed to receive the incoming antenna cables. The other end of the connector can be attached to the appropriate antenna cable so that the cable can be pre-installed within the pole interior 31 prior to its delivery to an installation site. In this way, at the base, the only connection required to be made when installing the pole is connecting the inground or incoming cables to the connectors 158. Preferably, the connectors incorporate lightning arresting properties, e.g., Huber+Suhner connectors. Alternatively, other modes of lightning arresting as part of the cable connections or other pole components can be employed.

At the other end of the pole 1 is an upper plate 161 mounted within the pole interior 31. The plate 161 has through holes 163 to permit cables to pass therethrough and provide cable alignment. The plate 161 is annular in nature to provide an opening 165 therethrough. J-hooks 167 are provided as a means of stress relief for the coaxial cable running through the pole 1.

The pole 1 includes access covers 169 as spaced intervals along its length to access the interior 31 of the pole. The access cover at the base allows the connection to be made between inground cables and the connectors 158. The access cover at the other end of the pole permits access to the plate 161.

Referring again to FIGS. 8A and 8B, the base plate 55 of the spool has through holes 171 to receive the antenna cables running up through the pole 1 from plate 161. U-shaped lifting handles 173 are provided as are busses 175, the busses facilitating antenna hookup. The cables 160, see FIG. 1, running through the pole and plate 161 can be hooked directly to at least one antenna or can be linked with jumpers for antenna connection.

The materials of construction and dimensions for the pole assembly 10 can vary depending upon the desired application. For example, the pole overall height could range from 50 to 100 feet with a 14 inch OD and the antenna module could have a ten foot height. The pole could be made from ASTM-A572 steel with the antenna radome being fiberglass reinforced plastic. Various finishes can be applied to any or all components of the pole assembly, paints, spray coatings or the like. Further, any conventional antennas can be employed as part of the pole construction. An EMS wireless dualpole antenna is but one example, but others may be employed.

Figure 23:
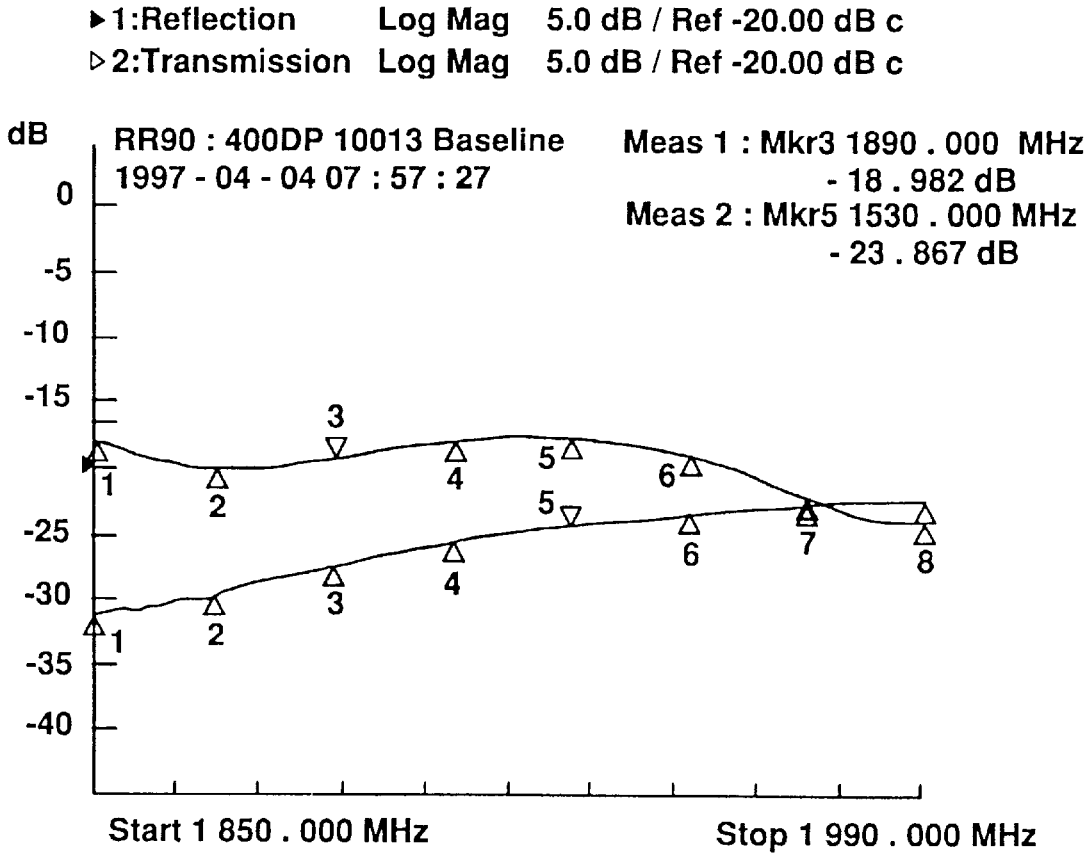
FIGS. 23 and 24 detail comparative testwork with and without the inventive radome.
Figure 24:
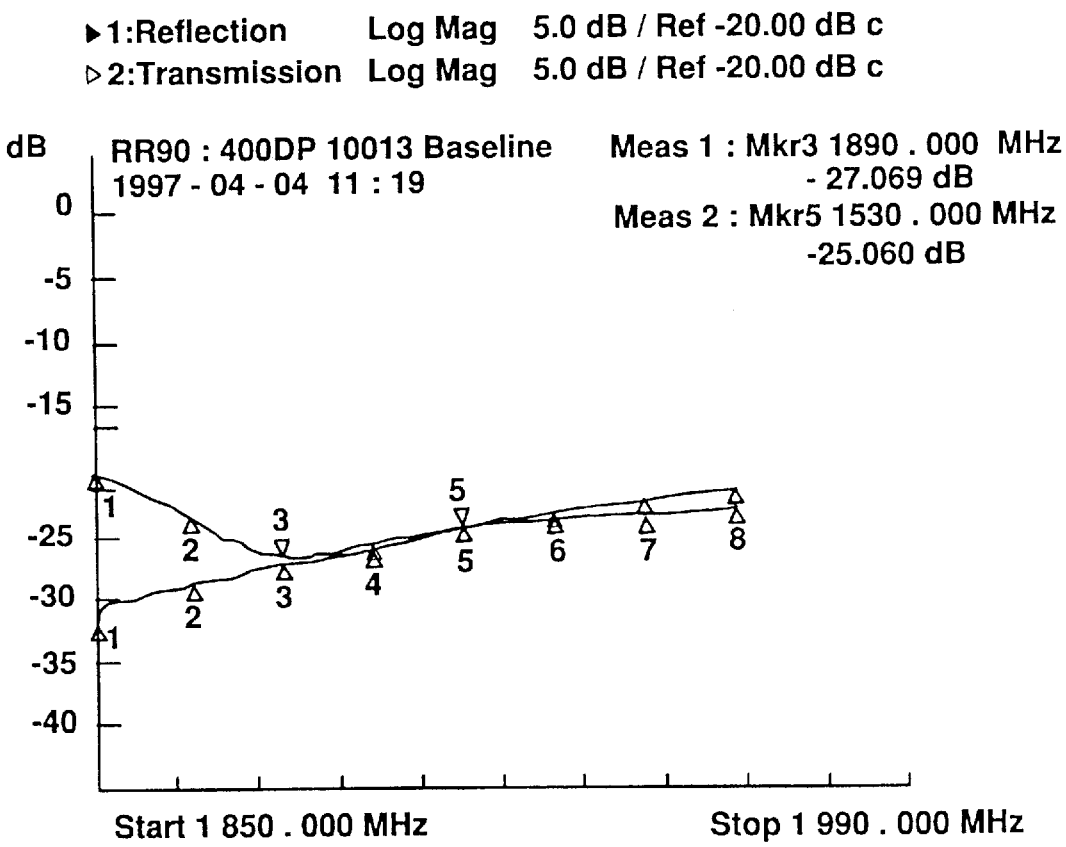

FIGS. 23 and 24 show tests relating transmission and reflectivity for antennas with and without a radome. As can be seen these two figures, the fiberglass radome, being a RF semitransparent material has a minimal effect on antenna performance.

The spool design for containing the antenna offers several advantages. First, the spool lower plate 55 eases connection to the top 95 of the pole and connection to transmission cables within the pole. Second, the spool upper plate 57 provides a support surface for a mechanism to raise and/or lower the housing. The spool upper and lower plates, by reason of their increased diameter over the spool tube therebetween, form a space to mount and/or arrange an antenna. By specifying the proper dimensions for the spool assembly, a wide variety of different configurations of antennas can be employed.

The pole design in FIGS. 18–22 is exemplary and other types of connectors, flanges, plates, etc., can be used. Moreover, different mounting locations for the various components can also be selected.

As stated above, a wide variety of pole configurations can be used depending on the environment of use. The pole can be made in different colors, e.g., green, gray burgundy, white or any another color, tone or combination thereof. The surface of the pole can have different textures, e.g., smooth, fluted, spiraled or the like. The pole can utilize different types of lighting fixtures and the ornamental features can be located on the pole, at the base or at or near the top of the pole assembly, e.g., flag poles. Of course, the pole can be devoid of other features so that it functions as a cell site only and blends in with its environment.

When the housing, cap and shroud are fiberglass, the pole color can be incorporated into the fiberglass manufacturing process, e.g., gel coating of the part surface. This feature provides longevity to the pole color and reduced maintenance. The radome can be any RF transparent or semitransparent material. Fiberglass or a fiberglass reinforced material such as a plastic or polymer are just examples of preferred materials. Other materials may include polymeric or fabric materials or other materials exhibiting the desired RF transparency. The radome construction may also be related to the antenna operation such that a particular degree of RF transparency is required.

The embodiment depicted in FIG. 1 illustrates a single antenna mounted on the spool. However, a plurality of antennas, the same or different, can be mounted in the pod created by the radome and the spool. A group of antennas may require the appropriate separation, e.g., isolation baffles or the like, so that one antenna does not impede the performance of other antennas. In addition, the spool may require other structural members or supports to facilitate mounting more than one antenna. When using a number of antennas, the spool base flange, plate 161 and base connection 150 may require modification to handle the increased number of cables, additional connectors, throughholes, j-hooks, additional plates or the like. Other pole components can be modified as needed to accommodate additional antennas.

Another advantage of the invention is the modular nature of the pole assembly. The pole assembly can be brought to a site where the foundation has been installed and easily and quickly erected. The antenna and cabling can be installed as part of the pole assembly prior to erection such that the only connection required is at the base connection once the pole assembly is erected. The components of the pole assembly can be assembled at the erection site or beforehand at a remote site.

In use, it is preferred to first install the concrete footer at a desired site. Once the footer is installed, the assembled pole assembly can be shipped to the site and installed with a crane. The in-ground cable connection can then be made as can the necessary adjustments to the antenna. The entire installation can be done in a day since the pole components are pre-assembled.

Accordingly, an invention has been disclosed in terms of preferred embodiments thereof which fulfill each and every one of the objects of the present invention as set forth above and provides a new and improved cell site pole assembly and method of use.

Various changes, modifications and alterations from the teachings of the present invention may be contemplated by those skilled in the art without departing from the intended spirit and scope thereof. Accordingly, it is intended that the present invention only be limited by the terms of the appended claims.

The invention claimed is:

1. A pole assembly for a cell site comprising:

a) an elongated hollow pole having a bottom and a top; and b) an antenna spool assembly mountable to the top of the pole, the antenna spool assembly comprising a spool and a housing surrounding the spool and being adapted to also surround at least one antenna arranged with the spool; and c) wherein, the pole includes antenna transmission cables therein and at least one connector located within the pole and at the bottom of the pole to facilitate field connection to incoming cables.

2. The pole assembly of claim 1, further comprising a foundation mountable to the bottom of the pole for supporting the pole assembly.

3. The pole assembly of claim 2, further comprising a base enclosure surrounding a connection between the bottom of the pole and the foundation.

4. The pole assembly of claim 1, further comprising a lightning arrestor.

5. The pole assembly of claim 1, wherein the housing includes a fiberglass component.

6. The pole assembly of claim 1, wherein the pole assembly includes a housing cap and a housing lower shroud.

7. The pole assembly of claim 1, wherein the pole includes at least one of a light fixture and a decorative item.

8. The pole assembly of claim 1, wherein a connection between the top of the pole and the antenna spool assembly includes openings for cable passage.

9. The pole assembly of claim 1, wherein the pole has different finishes, colors or textures on a surface thereof.

10. The pole assembly of claim 1, further comprising a decorative or functional component arranged at or near the top of the pole.

11. The pole assembly of claim 1, further comprising a counterbalance system for lowering or raising the housing to expose or conceal the antenna.

12. The pole assembly of claim 1, further comprising a guide plate arranged within the pole and near an upper end thereof, the guide plate configured to receive transmission cables leading to the at least one antenna.

13. The pole assembly of claim 1 wherein the connector comprises a connector plate mounted within the pole to facilitate the field connection.

14. A pole assembly for a cell site comprising:

a) an elongated hollow pole having a bottom and a top;

b) an antenna spool assembly mountable to the top of the pole, the antenna spool assembly comprising a spool and a moveable housing surrounding the spool and being adapted to also surround at least one antenna fixedly arranged with the spool; and c) a counterbalance system for lowering or raising the housing independently of the fixed antenna to expose or conceal the antenna.

15. The pole assembly of claim 14, wherein the counterbalance system is spring controlled.

16. The pole assembly of claim 4, further comprising a foundation to support the elongated hollow pole.

17. A method of installing a cell site pole comprising the steps of:

a) providing an elongated hollow pole having a bottom and a top, an antenna spool assembly mountable to the top of the pole, the antenna spool assembly comprising a spool and a housing surrounding the spool and being adapted to also surround an antenna arranged with the spool, and wherein, the pole includes transmission cables arranged between at least one of a base connector and a top connector, one or both connectors located within the pole facilitating field connection to incoming ground cables and connection to cables of the antenna spool assembly, either in the field or prior to delivery of the pole assembly to the field site; and b) erecting the pole assembly on a ground site.

18. The method of claim 17, wherein the incoming ground cables are attached to the transmission cables before or after erection of the pole and the antenna spool assembly is attached to the pole before or after pole erection.

19. The method of claim 17, wherein the pole assembly is provided with a counterbalance system for lowering or raising the housing to expose or conceal the antenna.

20. A pole assembly for a cell site comprising:

a) an elongated hollow pole having a bottom and a top;

b) an antenna spool assembly mountable to the top of the pole, the antenna spool assembly comprising a spool and a moveable housing surrounding the spool and being adapted to also surround at least one antenna arranged with the spool;

c) a counterbalance system for lowering or raising the housing to expose or conceal the antenna;

d) a connector located within the pole to connect incoming antenna cables to cables extending within the pole; and e) a cap assembly mountable to a top of the spool assembly.

21. The pole assembly of claim 20, further comprising a foundation attached to the bottom of the pole.

22. The pole assembly of claim 21, further comprising at least one of a lighting fixture and a decorative fixture.

* * * * *